US011551561B2

(12) United States Patent
De Riese

(10) Patent No.: US 11,551,561 B2
(45) Date of Patent: Jan. 10, 2023

(54) METHOD AND DEVICE FOR PLANNING FLIGHT TRAJECTORIES

(71) Applicant: Harris Orthogon GmbH, Bremen (DE)

(72) Inventor: Mathias De Riese, Bremen (DE)

(73) Assignee: Harris Orthogon GmbH, Bremen (DE)

( * ) Notice: Subject to any disclaimer, the term of this patent is extended or adjusted under 35 U.S.C. 154(b) by 174 days.

(21) Appl. No.: 16/723,569

(22) Filed: Dec. 20, 2019

(65) Prior Publication Data

US 2020/0202724 A1 Jun. 25, 2020

(30) Foreign Application Priority Data

Dec. 21, 2018 (EP) ..... 18215271

(51) Int. Cl.

| | |
|---|---|
| ***G08G 5/00*** | (2006.01) |
| *G08G 5/02* | (2006.01) |
| *G08G 5/04* | (2006.01) |

(52) U.S. Cl.

CPC ..... *G08G 5/0039* (2013.01)

(58) Field of Classification Search

CPC ..... G08G 5/045; G08G 5/0039; G08G 5/025; G08G 5/0026; G08G 5/0052; G08G 5/0034

See application file for complete search history.

(56) References Cited

U.S. PATENT DOCUMENTS

| | | | | |
|---|---|---|---|---|
| 2010/0217510 | A1 | 8/2010 | Deker | |
| 2010/0228468 | A1* | 9/2010 | D'Angelo | G08G 5/045 701/120 |
| 2015/0269846 | A1 | 9/2015 | De Prins | |
| 2017/0248421 | A1* | 8/2017 | Cope | G08G 5/0086 |
| 2017/0365178 | A1* | 12/2017 | Shay | G08G 5/0034 |
| 2018/0240348 | A1 | 8/2018 | Ren | |
| 2019/0012925 | A1* | 1/2019 | Barker | G08G 5/0091 |
| 2019/0088146 | A1* | 3/2019 | Salesse-Lavergne | G08G 5/045 |

* cited by examiner

*Primary Examiner* — Aniss Chad
*Assistant Examiner* — Madison R Hughes
(74) *Attorney, Agent, or Firm* — Seed Intellectual Property Law Group LLP

(57) ABSTRACT

A method for planning flight trajectories for at least two aircraft aiming to subsequently approach a predefined reference point, in particular a predefined destination, wherein each aircraft travels along a flight route according to an individual flight trajectory, such that a first aircraft travels along a first flight route according to a first flight trajectory and a second aircraft travels along a second flight route according to a second flight trajectory, wherein at least the second flight trajectory is set or adjusted such that at least one predetermined minimum separation between the two aircraft approaching the predefined destination according to their respective flight trajectories is ensured and the predetermined minimum separation is ensured throughout the whole flight trajectories by setting or adjusting an adjustable trajectory parameter (θ) of the first or second flight trajectory.

12 Claims, 5 Drawing Sheets

METHOD AND DEVICE FOR PLANNING FLIGHT TRAJECTORIES

BACKGROUND

Technical Field

The present disclosure is directed to a method for planning flight trajectories for at least two aircraft aiming to subsequently approach a predefined reference point, in particular a predefined destination such as a runway. The present disclosure is also directed to a corresponding planning device for planning such flight trajectories and the disclosure is directed to a corresponding computer program.

Description of the Related Art

One of the main tasks in Air Traffic Control (ATC) is to keep aircraft properly separated. This defines the background for all Air Traffic Management (ATM) services, many of which rely on forecasts provided by trajectory predictions. This problem of keeping aircraft properly separated is also directed to arrival flights of aircraft at the same airport and in particular at the same runway. Accordingly, the separation is directed to a distance between the at least two aircraft and to the time difference between these with respect to the same reference point.

Nowadays appropriate separations are incorporated by air traffic management tools such as an Arrival Manager (AMAN) at one point, e.g., the landing runway. Such concepts assume that that point, i.e., the landing runway is the most critical point, i.e., that at the landing runway two aircraft have the closest approach, i.e., the smallest separation. However, if the first aircraft of such two aircraft approaches the runway with a higher speed than the other aircraft the closest approach of both aircraft may not be at the landing runway.

One possibility to address this problem might be to ensure separations at several discrete points. That might be an improvement for advanced tools. However, in this case the minimum separation may not be ensured on continuous parts of the route. To ensure separations on continuous parts of the route one possibility might be assuming common speed profiles along these parts, i.e., if the separation is ensured at two adjacent points such separation may also be assumed on the part between these two points if the speed of both aircraft is constant and the faster aircraft is not overtaking the slower aircraft.

However, usually a separation on continuous parts of the route which two flights have in common is only indirectly guaranteed by assuming common speed profiles along these parts.

To further improve such air traffic management, trajectory prediction incorporates more and more details to increase the precision. This also takes into account that there is frequently more and more air traffic to be managed. There is a trend to design airspaces to be more flexible to allow efficient usage. Such developments lead to trajectories with individual and detailed speed profiles. Accordingly, it might soon become insufficient for an AMAN to assume common speed profiles or explicitly ensure separations only at discrete points.

The European Patent Office has cited the following prior art documents in the priority application: US 2018/240348 A1, US 2010/217510 A1 and US 2015/269846 A1.

BRIEF SUMMARY

One or more embodiments are directed to ensuring separation along continuous stretches based on a pair of trajectories with individual speed profiles. One or more embodiments is directed to a method is directed for planning flight trajectories for at least two aircraft aiming to subsequently approach a predefined reference point. Such predefined reference point may in particular be a predefined destination, such as the runway of an arrival airport.

A flight trajectory is basically a flight route or flight path with additional information, in particular the time or points in time at which the corresponding aircraft reaches particular points of the route or the flight path. Accordingly, a flight trajectory defines where the aircraft flies and when. It might in addition comprise information on how fast the aircraft flies at each point of its trajectory.

Each aircraft travels along a flight route according to an individual flight trajectory, such that a first aircraft travels along a first flight route according to a first flight trajectory and a second aircraft travels along a second flight route according to a second flight trajectory. The first and second flight routes can be different or can be partly or completely the same. Based on that at least the second flight trajectory is set or adjusted such that at least one predetermined minimum separation between the two aircraft approaching the predefine destination according to their respective flight trajectories is ensured. Such predetermined minimum separation may be a distance between the two aircraft and in this case the minimum separation may for example be 5 kilometers and that means that these two aircraft do not come closer than 5 kilometers.

It is further suggested that the predetermined minimum separation is ensured throughout the whole flight trajectories. Accordingly, picking up the last example, the two aircraft never get closer than 5 kilometers.

Accordingly, the suggested method does not only ensure such minimum separation for a single destination point such as the runway of an arrival airport, or even for two or more predefined points along a travel path, but that such predetermined minimum separation is ensured throughout the whole flight trajectories.

It was found that according to individual speed profiles of these two aircraft, the aircraft may come closer than the minimum separation, if only the predefined destination is observed. Even when considering more points along the flight path of flight trajectories the separation between the two aircraft may be smallest in between of such two predefined points.

Instead of that, it was found that it is important to consider not only a few points along the trajectories, but to consider the whole flight trajectories in order to ensure said predetermined minimum separation.

It is thus suggested that the predetermined minimum separation is ensured throughout the whole flight trajectories by setting or adjusting an adjustable trajectory parameter of the first or second flight trajectory. Accordingly, by using an adjustable trajectory parameter, in particular an arrival time difference between the first and second aircrafts, the first or second flight trajectory, or both, can be defined to ensure the minimum separation throughout the whole flight trajectories. Simply speaking, it was realized that the closest approach may be anywhere between the two flight trajectories and at least one of these two flight trajectories is changed, e.g., shifted, by the adjustable trajectory parameter such that this closest approach becomes as big as the minimum separation.

One embodiment uses only one adjustable trajectory parameter, but there could also two or several parameters be used.

Below it is described how to change the second trajectory, i.e., the trajectory of the second aircraft following the first aircraft. However, the described and explained method can also be used for changing the first trajectory, or both trajectories, without departing from the scope of the invention. Even both flight trajectories are considered, that may however not mean, that the whole flight trajectories of both aircraft are considered from starting airport to arrival airport, as usually the starting airport of both aircraft are not the same and thus it is only necessary to define the relevant flight trajectories in the proximity of the arrival runway, e.g., this might be 12 nautical miles (12 NM) before the arrival airport, to give a simple example. These relevant parts of the flight trajectories can be understood as the whole flight.

In particular, for the cases where the flight trajectories of two aircraft have an identical flight route but different times, it might also, under consideration of the speed of the aircraft, be possible to observe a time difference as minimum separation. At least with known flight speed, a minimum separation in the meaning of a minimum distance can be transformed in a minimum separation being defined by a minimum time difference. Regulations may specify the passage of the same point by two flights to be separated by a minimum time difference. However, further features and explanations given below are focusing mainly on a distance as a minimum separation. However, this can be equivalent to a time lag defining a minimum separation.

According to one aspect, an arrival time difference defining a time difference between the first and the second aircraft to reach the predefined reference point is determined as a parameter of the second flight trajectory and the arrival time difference is determined such that the predetermined minimum separation is ensured throughout the whole flight trajectories.

It is generally a common task, e.g., in arrival management (AMAN) systems to set an arrival time difference, i.e., to set an arrival time for a second aircraft with respect to the arrival time of a first aircraft that lands before the second aircraft. However, it was realized that setting such arrival time difference to ensure a predetermined minimum separation at the point in time of the arrival of the first aircraft does not necessarily mean that that is the minimum separation throughout the whole flight trajectories. Instead, it was realized that there might be smaller separations than the minimum separation, in particular smaller distances at an earlier state. One possibility could be, that the first aircraft is generally having a higher speed than the second aircraft. It is also possible that the first aircraft is generally having a higher speed than the second aircraft, but according to reducing the flight speed close to arrival the speed of the first aircraft becomes smaller than the speed of the second aircraft but only in a very late state just before the final arrival. In that situation, the smallest separation can be at any time before the arrival of the first aircraft.

Accordingly, this aspect suggests a solution that the arrival time difference for the second aircraft to the first aircraft is set such that the predetermined minimum separation is ensured throughout the whole flight trajectories of these two aircraft.

According to one aspect, the first flight trajectory is associated to a preceding aircraft approaching the reference point before a following aircraft and the second flight trajectory is associated to the following aircraft reaching the reference point subsequently after the preceding aircraft. For this constellation the second flight trajectory, at least part of it, is calculated or adjusted based on the first trajectory and based on the minimum separation such that the second flight trajectory ensures the minimum separation with respect to the first trajectory.

According to this suggestion, the first flight trajectory and thus the flight trajectory of the preceding aircraft is just taken as given information and is not further amended in order to ensure the minimum separation. Of course, the first flight trajectory of the current situation might have been the second trajectory of a preceding situation. However, the general underlying idea is that the following trajectory is accepting the trajectory of the preceding aircraft and thus the following trajectory is, if necessary, adjusted accordingly in order to ensure the predetermined minimum separation throughout the whole flight trajectories.

According to one aspect, each flight trajectory comprises at least one of:

- a plurality of nodes; and
- at least one trajectory segment connecting a preceding nodes and the following node.

According to one aspect, each flight trajectory comprises a plurality of trajectory segments.

Each node is defined at least by:

- a node location defining the location of the node;
- a node time defining a point of time for the respective aircraft to reach the node location; and optionally
- a flight speed of the respective aircraft at the node.

The node location may be defined by absolute coordinates, but according to one aspect, it is suggested that the node location is defined by a distance to the predefined reference point. Underlying this concept is that at least the first and second flight trajectories both use the same route. Accordingly, the first and the second aircraft fly along the same route but of course at different times, i.e., the first aircraft flies first and the second aircraft later, in particular a few minutes later, may be less. This is particularly designed for flight trajectories defining the approach of the aircraft to an arrival runway. This assumes that in a certain distance from the arrival runway the different routes of both aircraft, as these probably come from different starting airports, merged to one route. This route is primarily defining a common route to approach the arrival airport, in particular the arrival runway. There may of course be at least one further route for the same arrival runway for other wind directions.

The node is also defined by a node time defining a point of time for the respective aircraft to reach the node location. In other words, this node time may just define when the respective aircraft reaches the predefined distance to the predefined reference point defining the particular node location.

In other words regarding the approach of two aircraft to a particular arrival runway a trajectory may define certain distance to the arrival runway, such as 5 km, 10 km, 15 km and 20 km before the arrival runway. However, these do neither need to be of equal distance nor be the same for both trajectories. The flight trajectory may then be defined by these distances and the points in time when the aircraft reaches all these distances. For such definition of a flight trajectory, at least the relevant and common parts of the flight trajectories have the same route. In other words, the flight trajectory may be defined by the question, when is each aircraft how close to the arrival runway.

However, the flight speed of the respective aircraft at each node may also be additional information and that may be part of the definition of a node of a flight trajectory. This is in particular advantageous if each aircraft has an individual speed profile. In this case, all routes of all these flight trajectories may be the same but the particular points of time and the particular speed, i.e., the particular speed profile define the flight trajectory for each aircraft.

The flight trajectory may also be defined by trajectory segments connecting a preceding node and the following node. Preferably, there is a plurality of flight trajectory segments. One of such segments may be a segment connecting the arrival runway with the first distance of 5 km, to use the above example again. And another trajectory segment may be one connecting the 5 km distance with the 10 km distance, and another one may be the segment connecting the 10 km distance and the 15 km distance. However, each of these trajectory segments is also defined by the point of time of said defined distances with respect to the point of time at the arrival at the arrival runway.

However, in a particular embodiment it might be enough just to have two nodes and one trajectory segment, i.e., connecting these two nodes. One of these nodes is the predefined reference point, in particular, the arrival runway and the other node may just be the last distance before the arrival runway.

According to one aspect, the position of the aircraft at any point in time within a trajectory segment between two nodes is modeled by a position function. In addition or alternatively, the time of the aircraft at any location within the trajectory segment between two nodes is defined by a time function.

According to both aspects, which may be combined, there is only an analytical definition of the position or time of the aircraft respectively and thus a function modeling or defining it. Accordingly, this function can be used, in particular in an analytical way, to analyze the flight trajectory with the varying parameters. The idea is to finally set or define the second flight trajectory in order to ensure the minimum separation for the whole flight trajectory. Accordingly, the whole flight trajectory, including the segment in between nodes will be known by using said position function or time function. Any change of parameters, in order to adjust at least the second flight trajectory can be considered throughout the whole flight trajectory if such position function or time function is used for modeling or defining the corresponding trajectory segment.

According to one aspect, the position function or the time function respectively is given by a polynomial function and/or the position function or the time function respectively comprises a predefined constant acceleration between two nodes over ground assuming a constant acceleration of the aircraft travelling along the respective trajectory segment, i.e., travelling along the respective route underlying the trajectory segment. Alternatively, or additionally, the position function or the time function may at least be based on such constant acceleration.

Said polynomial function may thus define said position function or time function. Using such mathematical description enables a generalized description of said position or time and such description can be used for further calculation in particular for further finding a solution that results in ensuring the minimum separation for the whole trajectory.

A simple form of such polynomial function may also define a constant acceleration. In this respect, using a polynomial function and defining a constant acceleration are combinable.

Using a constant acceleration provides a particularly simple method of describing the individual behavior of each aircraft for each trajectory segment. The underlying idea is that the assumption of constant speed between two nodes along a trajectory segment is too simple and may not reflect the actual situation or would specify a much higher number of segments per trajectory. In particular, individual flight speed profiles may not be reflected correctly. As a result, a solution might be found that ensures a minimum separation for each node but not for the trajectory segment between such two notes.

Assuming a constant acceleration might still be a simplification of the reality. However, such constant acceleration is fairly close to reality. In this respect, it was found that said nodes often define points of the flight trajectory and thus points of the route the aircraft flies, at which the aircraft changes its flight behavior. Accordingly, if at one node the aircraft receives, e.g., a particular time to reach the next node making it necessary for the aircraft to change its flight speed, this will result in an acceleration or deceleration that will take place at this coming segment approaching the next node. The aircraft will not abruptly change its flight speed, as that is physically not possible and even a too strong or hard acceleration will stress the aircraft to much and thus such change of flight speed will be done smoothly resulting in a fairly constant acceleration.

At the next node, a new acceleration may be relevant and that can be considered. However, the underlying idea is that finally the result of the method for planning flight trajectories results in a flight trajectory which the aircraft is expected to follow. For such flight trajectory which is thus given by this method for the aircraft to follow it makes sense to assume constant accelerations.

According to one aspect, a last node of each flight trajectory defines a destination at a runway and/or a first node of each flight trajectory defines a starting point at a runway. Many aspects explained above are directed to the aspect that the last node of each flight trajectory defines a destination at runway, i.e., the last node of a corresponding route of the flight trajectory defines the destination at a runway. In other words for this aspect the arrival of at least two aircraft at a runway is planned.

However, the same underlying idea can also be used to plan the start of at least two aircraft starting one after another from a runway. This may particularly be useful when such aircraft have to follow for a certain distance a common route. The reason for this may be geographical reasons near the airport of that runway. The presence of urban areas close to the runway may also be the reason for a strict route to follow when starting for a particular airport.

However, it is also possible to plan the complete travel of an aircraft from a starting point at one runway to arriving at another runway.

It is also possible to plan part of the travel of two aircraft, e.g., along a common route segment neither starting nor ending at a runway, by determining one or more parameters of the trajectory of the second flight, e.g., the time it passes a defined point within that common route.

According to one aspect, at least the first flight trajectory and the second flight trajectory use the same route but at different time and in particular with individual flight speeds. Accordingly, the aircraft are guided along the same flight route and the flight planning, i.e., planning each flight trajectories is focused on providing a time frame for each aircraft which each aircraft has to use to fly along the flight route. It is particularly provided for a flight route for approaching an arrival runway. As explained above aircraft coming from different origins merge their flight routes to one flight route in the proximity of an airport and in particular in the proximity of a corresponding arrival runway. However, such common route for the flight trajectories is not only restricted to this example.

In addition, one aircraft after another may be guided on the same flight route to the predefined reference point, in particular to said arrival runway and this can consider the different speed profiles of the aircraft. Each flight trajectory may provide a particular timeframe and thus a particular flight trajectory for each aircraft, but that does not mean that all aircraft receive the same time frame, just shifted by a particular time difference. Instead, each aircraft is individual and has individual abilities and thus individual speed profiles are to be considered. The proposed solution that ensures a minimum separation throughout the whole flight trajectories can take such different speed profiles into account.

According to one aspect for each flight trajectory and each trajectory segment n it is defined a distance D(t) over ground with respect to a predefined reference location along the defined route, in particular the predefined reference point or the final destination, by the following equation depending on time t:

$$D(t)=D_n(t-t_n)=1/2a_n(t-t_n)^2+v_n(t-t_n)+d_n,$$

wherein:

- $D_n(t-t_n)$ defines for trajectory segment n a distance D over ground along a predefined route from any point P on the segment to the predefined reference location, where the parameter $(t-t_n)$ is the flight duration between this point P and the following node of the segment;
- $d_n$ defines the distance of the following node of the trajectory segment n to the predefined reference location;
- an defines a constant acceleration of the aircraft throughout the trajectory segment n, of the aircraft;
- vn defines the speed of the aircraft at the following node of the trajectory segment n; and
- tn defines the point in time at which the aircraft reaches the following node of the trajectory segment, wherein $d_n$, $a_n$, $v_n$, and $t_n$, each forms a characteristic parameter of the trajectory segment.

This way a general description of each trajectory segment is provided whereas this description is based on the same predefined reference location or reference point for all trajectory segments. This way there is a generalized description for the whole trajectory. Using such definition of two flight trajectories the separation between these two flight trajectories can be calculated in a generalized way. The calculation uses characteristic parameter of the trajectory segment that is described, i.e., the characteristic parameters $d_n$, $a_n$, and $t_n$.

According to one aspect, the setting or adjusting of at least the second flight trajectory uses:

- at least one determination function for determining the at least one adjustable trajectory parameter of the second flight trajectory, and
- the determination function is calculated based on:
  - a separation function defining a separation between the two aircraft travelling according to the first and the second trajectory, at least for part of their travel and/or at least for a part of the first and a part of the second trajectory;
  - the separation function depends on the first and second flight trajectories
  - the separation function depends on at least one adjustable trajectory parameter of the second flight trajectory, wherein
  - the determination function is calculated by determining a point in time of a local minimum of the separation function as an analytical expression; and in particular
  - the separation function is dependent on time and the point in time of the minimum of the separation function is inserted into the separation function such that an analytical expression for the separation function at the minimum results which is independent of time, in particular
  - the resulting separation function at the minimum is set equal to the predetermined minimum separation (σ) and resolved for the at least one adjustable trajectory parameter (θ), in particular, the separation function S(t, θ) is defined as:

$$S(t,\theta)=D_A(t)D_B(t,\theta).$$

with:

- t as the point in time;
- θ defining as the adjustable trajectory parameter a time difference between the points of time for the first and the second aircraft to reach the predefined reference point;
- $D_A(t)$ defining an analytic expression for the distance of the first aircraft to the predefined reference point being dependent on time (t), and preferably not being dependent on the time difference (θ) between the first and the second aircraft at the predefined reference point; and
- $D_B(t, \theta)$ defining an analytic expression for the distance of the second aircraft to the predefined reference point being dependent on time and being dependent on the time difference (θ) between the first and the second aircraft at the predefined reference point.

It is pointed out that the adjustable trajectory parameter θ in particular the time difference between the points of time for the first and the second aircraft to reach the predefined reference point, influences characteristic parameters of the trajectory segment, at least one or some of them. As the distance function, in particular the distance function $$D(t)=D_n(t-t_n)=1/2a_n(t-t_n)^2+v_n(t-t_n)+d_n,$$

depends on such characteristic parameters the distance function thus depends on the adjustable trajectory parameter θ.

Accordingly a determination function is suggested that determines, in particular calculates, the setting or adjusting of at least the second flight trajectory. One possibility to set or adjust the at least second flight trajectory is to calculate an arrival time difference, which is depicted with the Greek letter θ. This arrival time difference may also be an adjustable trajectory parameter of the second flight trajectory. Such determination function may be calculated for each trajectory segment and thus a plurality of determination functions may be used. How these plurality of determination functions may interact will be described later.

The determination function is based on a separation function defining a separation between the two aircraft travelling according to the first and the second trajectory, at least for part of their travel and/or at least for part of the first and a part of the second trajectory. Accordingly, for calculating the determination function a separation function may be defined first. The separation function may thus define a distance between the two aircraft as an analytical expression. One possibility to calculate such separation function is to take the difference between an analytic expression defining a first distance function defining the distance of the first aircraft to the predefined reference point and a second distance function defining the distance of the second aircraft to the predefined reference point. In particular, the first and the second distance function define a distance of the first or second aircraft respectively to the same arrival runway.

According to this example, the separation function thus defines a distance between the two aircraft.

The separation function may be modelled such that it at least depends on the second flight trajectory. Preferably, the separation function is defined as the difference between the first and the second distance function. In particular, the second distance function may be defined as being dependent on the arrival time difference, such that this arrival time difference is considered as an adjustable trajectory parameter, whereas the first distance function may not be dependent on the arrival time difference. As a result, the first distance function may be defined such, that it does not contain further individual parameters, which are not also present in the second distance function. However, the separation function may depend on the second flight trajectory and the first flight trajectory as well. It is to mention that using a distance function may be one way of defining the corresponding trajectory or at least part of the corresponding trajectory.

It is thus suggested that the separation function depends on at least one adjustable trajectory parameter of the second flight trajectory. In particular, the separation function is calculated by a difference of the first and the second distance function and this way a parameter of the second distance function and thus an adjustable trajectory parameter of the second flight trajectory remains in the separation function. In other words, the separation function is defined by an analytic expression and this analytic expression comprises at least one adjustable trajectory parameter of the second flight trajectory. In particular, it is suggested that the separation function and thus said analytic expression of the separation function depends and/or comprises the arrival time difference θ.

As a further step, it is suggested to determine a point in time of a local minimum of the separation function. This local minimum can be used to calculate the determination function. In particular, the separation function is differentiated with respect to time. This way said minimum of the separation function may be found, i.e., the minimum is at that point in time where the differentiation of the separation function with respect to time is 0 or at the point in time where the considered parts of the trajectories begin or end.

In particular, a separation function is used which is dependent on time, the minimum of the separation function is provided as an analytical expression and this analytical expression is determined such that an expression results which is independent of time. In other words, the differentiation of the separation function with respect to time is set to 0 and this equation is resolved and the result is inserted in the separation function such that the variable time (t) is eliminated.

Preferably, the separation function is defined such that the point in time when the distance between the two aircraft is at a minimum is considered by a corresponding parameter namely be the parameter $t_{mn}$ which can be named as time of minimum distance.

It is according to one aspect suggested that the differentiation of the separation function with respect to time, setting that to θ and resolving it in order to eliminate the variable time t, may be done such that an analytic expression for the time of minimum distance $t_{min}$ results. It is also suggested that additional conditions may result in the time of minimum distance $t_{min}$ as an analytical expression pertaining to the start or end time of the considered parts of the trajectory. In particular, this analytic expression for this time of minimum distance $t_{min}$ depends on the arrival time difference θ.

Such analytical expression for the time of minimum distance $t_{min}$ is inserted in the separation function, which results in an analytical expression for the separation function which is independent of time and still dependent on the arrival time difference θ. The value of this analytical expression may be interpreted as the minimum of the separation function.

It is suggested that the analytical expression for the minimum of the separation function is set equal to the predetermined minimum separation σ and can then be resolved such that the arrival time difference θ may be calculated. However, it is important to note that for resolving said analytic expression a solution of a quadratic equation may be needed and accordingly, there may not only be one solution. However, the result received by resolving said analytic expression is the determination function.

According to one aspect, such determination functions are prepared in an offline process and a plurality of such determination functions may be prepared, but as analytic expressions. These plurality of determination functions may be stored and used as a template, in particular as computer programs or program parts, for each new pair of flight trajectories for which a minimum separation are to be ensured. It is particularly important to point out that according to this suggestion some analytical mathematical transformation, in particular the differentiation by time and the resolving of a quadratic equation, which are of course also done in an analytical way, do not need to be performed during each new planning for a new pair of flight trajectories.

According to one aspect, it is therefore suggested that:

- the separation function is determined as an analytic expression;
- the separation function is given:
  - as the difference of the first trajectory and the second trajectory;
  - as the difference of a trajectory segment of the first trajectory; and
  - a trajectory segment of the second trajectory;
- the separation function is differentiated with respect to time in order to find a or the minimum;
- the differentiated separation function is used to find an analytical expression for the point in time at which the separation function has its minimum; and
- the analytical expression of time is inserted into the separation function and the separation function is set equal to the predetermined minimum separation in order to find a function depending on the predetermined minimum separation and being independent of time and resolving it in order to receive the at least one determination function, wherein
- the determination function is dependent on the predetermined minimum separation.

This way it is possible to ensure the minimum separation throughout the whole flight trajectories by calculating an arrival time difference θ according to the steps described for calculation or determining the determination function. Additionally, rules and conditions describing how to determine the correct function to calculate the at least one adjustable trajectory parameter, in particular to calculate the arrival time difference θ can be considered. The correct function according to that understanding is particularly a function that fulfils corresponding rules and conditions. Examples for this are given below when describing the formulas in detail. However, to give one general example, it is commonly known to the skilled person that for solving a quadratic equation there are usually two solutions but usually only one of the solutions makes sense and thus only one of the solutions is a correct solution and thus leads to the correct function to calculate the wanted adjustable trajectory parameter, in particular to calculate the arrival time difference θ.

According to a further aspect of any preceding methods:

a first distance function and a second distance function are each defined as analytical expressions for each trajectory segment of the first and second trajectories, respectively;

a or the separation function is defined as an analytical expression for each time interval where segments of the first and second trajectories overlap;

a point in time of the minimum of the separation function is determined as at least one analytical expression for each overlapping time interval, wherein the analytical expression depends on the at least one adjustable trajectory parameter (θ) of the second flight trajectory;

the at least one determination function is determined as analytical expression based on each analytical expression of the point in time; and determining the at least one adjustable trajectory parameter of the second flight trajectory using the at least one determination function such that the value of the minimum separation of the corresponding overlapping time interval will never be below the predetermined minimum separation, and in addition or alternatively the separation function is defined as:

$$S(t,\theta)=D_A(t)-D_B(t,\theta).$$

with the parameters as defined above.

This way the predetermined minimum separation, namely the overall minimum separation, can be achieved by piecewise ensuring that the minimum separation for each overlapping time interval where segments of the first and second trajectories overlap, does not exceed the overall minimum separation. Segments having overlapping time intervals can be denoted as overlapping segments and segments having identical time intervals can be denoted as matching segments.

According to one aspect:

a or the at least one determination function, is successively applied to a current pair of two current trajectory segments of the first and second trajectories;

the at least one determination function comprises at last one related characteristic parameter each corresponding to a characteristic parameters of the two trajectory segments, in particular at least one constant acceleration of at least one of the two trajectory segments; and successively applying the at least one determination function is performed by setting the value of each related characteristic parameter of the determination function to the value of the corresponding characteristic parameter of the respective trajectory segment in order to determine a value of the adjustable trajectory parameter (θ) of the second flight trajectory.

The determination function is designed such that it calculates the at least one adjustable trajectory parameter, in particular the arrival time difference θ such, that a minimum separation is ensured. However, when the flight trajectories are defined by a plurality of trajectory segments such calculation needs to be repeated for each overlapping pair of trajectory segments. Accordingly, such calculation is successively performed until all pairs of two overlapping trajectory segments have been considered. The pair of two current trajectory segments defines that particular pair that is used for calculation in the actual repetition. For each calculation there will be the adjustable trajectory parameter the result of the calculation. In particular, each calculation will generate a value for the arrival time difference θ. Of the plurality of arrival time differences received this way, simply speaking, the largest arrival time difference needs to be picked in order to ensure a minimum separation not only for the corresponding trajectory segment pair, but to ensure the minimum separation for the whole flight trajectories, i.e., for all overlapping segment pairs.

Even further, the trajectory segments of the first and the second trajectories do not necessarily match and accordingly applying the determination function is basically suggested for each overlapping area of corresponding segments of the first and second trajectory. Of course, such calculation is also suggested for matching segments of the first and second trajectories, if such matching segments exist. It shall also be noted, that for applying at least one determination function the formerly mentioned rules and conditions have to be considered and such rules and conditions may include information on the particular overlapping area of the two segments. According to one example, such rules and conditions may include where the one segment ends with respect to the other segments.

According to one aspect, it is suggested that:

in a first step determining an initial minimal value for the at least one adjustable trajectory parameter (θ);

in a second step determining a current pair of trajectory segments comprising as current segments a first segment of the first trajectory and a first segment of the second trajectory, wherein the following node of the first trajectory segment defines the destination at a runway and the second trajectory segment contains the point separated by the predetermined minimum separation from the runway;

in a third step applying a or the determination function(s) to the current pair of trajectory segments for determining or changing the minimal value of at least one adjustable trajectory parameter (θ) of the second flight trajectory;

in a fourth step determining a new current pair of trajectory segments, in particular based on the so far determined minimal value of the at least one adjustable trajectory parameter; and in a fifth step repeating third and fourth steps until a minimal value, in particular the smallest value, for the at least one adjustable trajectory parameter (θ) of the second flight trajectory is found such that the predetermined minimum separation (σ) is ensured for the complete second trajectory with respect to the first trajectory, wherein in particular the at least one adjustable trajectory parameter (θ) is the arrival time difference.

Accordingly, the process starts with a minimal value for the at least one adjustable trajectory parameter. If that is the arrival time difference, its minimal value, i.e., the minimal value of the arrival time difference can be calculated as a flight duration of the second aircraft for a distance being as long as the predetermined minimum separation. As the flight speed of the aircraft will probably not be constant and in particular will be the smallest just before the arrival, the final part of its flight route having a length of the predetermined minimum separation is used. Accordingly, the final part of its flight trajectory is used and the corresponding speed profile is used.

Based on that, basically any kind of at least partially matching trajectory segments of the first and second trajectories are taken and for each of these the minimal value is determined. Whenever this minimum value is larger than the previous minimum value this larger value is taken. This is thus repeated for each pair of trajectory segments and the result is a smallest value for the at least one adjustable trajectory parameter, in particular for the arrival time difference which still ensures the predetermined minimum separation for the complete second trajectory with respect to the first trajectory. This will in fact be the largest value found during repeating the third and fourths steps.

According to a further aspect and referring to the above explained control loop for applying the determination function it is suggested that in the fourth step the new current pair of trajectory segments is determined by:

exchanging for the first trajectory and/or the second trajectory each:

the current trajectory segment by a new current trajectory segment, wherein the current trajectory segment and the new current trajectory segment are connected by having a common node; and the new trajectory segments of both trajectories overlap in the time domain; and wherein the first and the second trajectories are exchanged both at the same time only if the common node connecting the current and the new trajectory segments have the same node time for the first and the second trajectory; and/or in the second step applying the determination function to the current pair of trajectory segments is restricted to an overlapping area, wherein the overlapping area is defined by time interval that covers both trajectory segments of the current pair of trajectories; and/or in the first step the first segment of the second trajectory, in particular the at least one adjustable trajectory parameter (θ) of the second flight trajectory, is set as a starting point such that the predetermined minimum separation between the first and second trajectories occurs at the point in time when the aircraft according to the first trajectory lands. In particular, the initial minimum value of the at least one trajectory parameter (θ) is calculated as a flight duration of the second aircraft for a final part of its flight trajectory of a length equal to the predetermined minimum separation before reaching the predefined reference point, in particular the runway.

Accordingly, a solution is provided that enables calculating or changing the minimal value of the at least one adjustable trajectory parameter for each pair of trajectory segments in an efficient way. The suggested solution ensures that no overlapping or matching area of two trajectory segments of the two trajectories is overlooked. This way it is ensured that the smallest value for the at least one adjustable trajectory parameter of the second flight trajectory is found such that the predetermined minimum separation is ensured for the complete second trajectory.

According to a further aspect, it is suggested that:

the first trajectory is given as a fixed trajectory;

the second trajectory is set or adjusted such, that the at least one predetermined minimum separation between the two aircraft is ensured; and the at least one adjustable trajectory parameter (θ) of the second flight trajectory is adjusted such that the second flight trajectory is shifted with respect to the first flight trajectory in order to thereby ensure the predetermined minimum separation between the first and second flight trajectories.

This way a solution is suggested that provides a fairly simple adjustment of the second trajectory, namely just to shift this trajectory with respect to the first flight trajectory and thus with respect to time. However, this is done in a way that a minimum separation is ensured throughout the whole flight trajectories. It also important to note that accordingly the improved method can easily be implemented in known systems. At least some known systems can shift a second flight trajectory, but cannot ensure the minimum separation throughout the whole flight trajectory, but often can only ensure the minimum separation for the arrival situation, i.e., when the first aircraft arrives at the arrival runway.

An embodiment is also directed to a device for planning flight trajectories for at least two aircraft aiming to subsequently approach a predefined reference point, in particular a predefined destination, comprising a processing unit, in particular a microprocessor, adapted to perform the planning of the flight trajectories, wherein each aircraft travels along a flight route according to an individual flight trajectory, such that a first aircraft travels along a first flight route according to a first flight trajectory and a second aircraft travels along a second flight route according to a second flight trajectory, wherein at least the second flight trajectory is set or adjusted such that at least one predetermined minimum separation between the two aircraft approaching the predefined destination according to their respective flight trajectories is ensured, and the predetermined minimum separation is ensured throughout the whole flight trajectories.

According to one aspect, the device for planning flight trajectories is adapted to perform a method as described above with respect to any aspects of the method explained above. In particular, the device has at least one of these methods according to at least one aspect implemented on its processing unit.

An embodiment is also directed to computer program prepared to perform a method according to any of the predefined aspects when executed on a computer.

BRIEF DESCRIPTION OF THE SEVERAL VIEWS OF THE DRAWINGS

The Invention is now explained in more detail according to at least one aspect as an example based on the accompanying figures.

DETAILED DESCRIPTION

Figure 1:
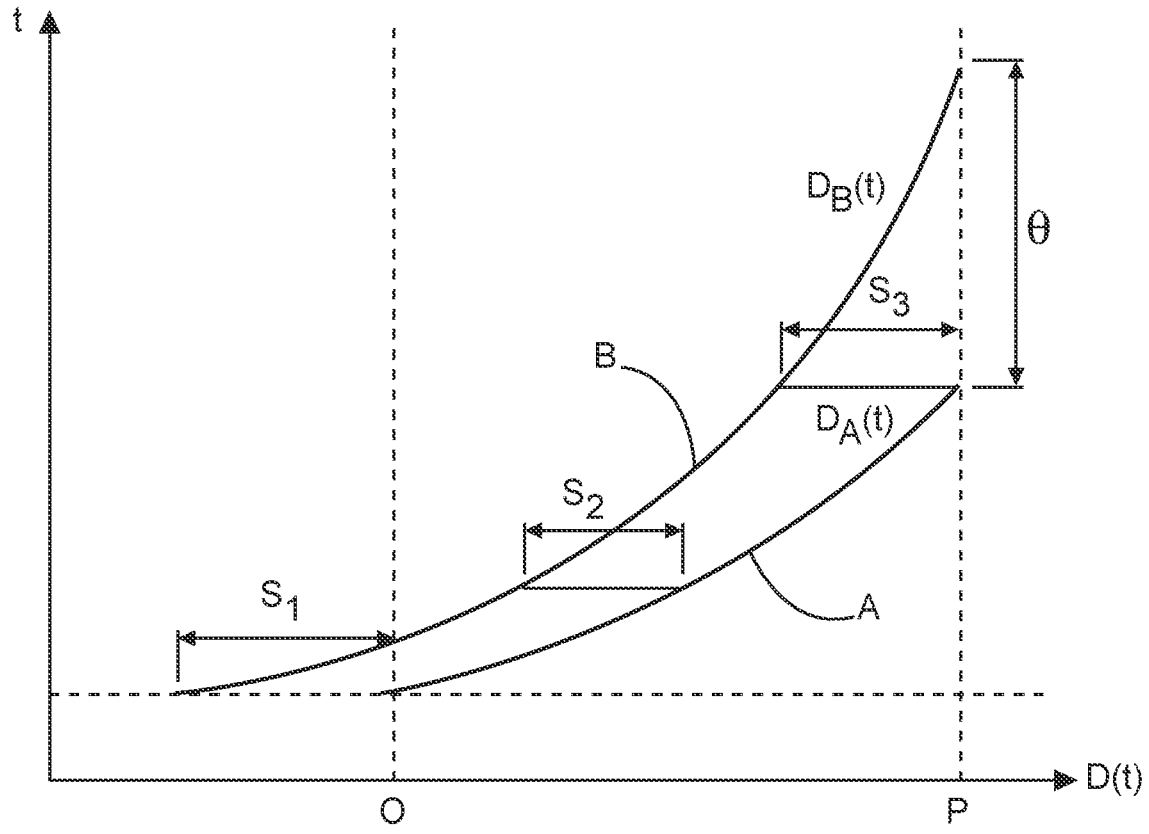
FIG. 1 shows an illustrative diagram of two trajectories of landing flights, but only the flying-distance D in relation to the flying time t.

FIG. 1 shows two trajectories of landing flights, but only the flying-distance D in relation to the flying-time t. Both flights decelerate and, thus, the lines are curved upward. They both end at the same point P, but at times separated by θ.

The task is to determine θ. The separation S has to be greater or equal to the given a at all points in time. As an example, three separation values $S_1$, $S_2$, and $S_3$ are shown.

FIG. 1 also illustrates relevant parts of the trajectories. The first point in time, where the minimum separation σ has to be ensured, is when the first flight A reaches the point O, where both flights start to use the same route. At that moment, flight B has not yet reached the start of the common route O, but already has to be separated, i.e., $S_1 \geq \sigma$. After flight A lands, separations and trajectories are not used any longer to ensure safe operations. Other measures are more appropriate. Therefore, the moment flight A lands is the last point in time, where the minimum separation has to be ensured, i.e., $S_3 \geq \sigma$. In the FIG. 1, $S_2$ is just an example of a separation at an arbitrary point in time within the relevant time interval. In the illustration it happens to be smaller than $S_1$ and $S_3$.

According to one aspect, trajectories are given as a list of nodes defining points in space and time each with additional information about the predicted state of the flight at that point, e.g., the speed. These nodes are not shown in FIG. 1 but further explained with respect to FIG. 2. On the final part of the approach, these nodes are defined by the local arrival procedures which result in a set of flight maneuvers like, e.g., change of altitude (climb or descend) or change of speed (acceleration or deceleration).

These trajectory nodes split a trajectory into segments. During each segment, the flight is assumed to behave in a specific way, such as:

level flight with constant speed;

change of altitude with constant air speed; or change of speed at a constant altitude.

The trajectory nodes define the start and end conditions for these segments, which are explained in FIG. 2 below.

For the purpose of the given task, the relevant information in a trajectory is the traversed distance over ground D(t) as a function of the time t (See FIG. 1). The full 3D position is not needed. It suffices to consider the lengths and flying times of the segments and the ground speeds at the trajectory nodes. These are direct results of a typical trajectory predictor.

If a trajectory predictor generated regular sampling points, e.g., every 10 seconds, a linear interpolation between the points would be sufficient assuming constant speed between points. Such trajectories would comprise of a large amount of points. Ensuring separation with such trajectories would mean transferring, storing, and iterating over them, therefore impairing performance of the system. It is preferred to handle trajectories containing points only where flight behavior changes. Therefore, we cannot assume constant speed between points. Such points are described as nodes.

Figure 2:
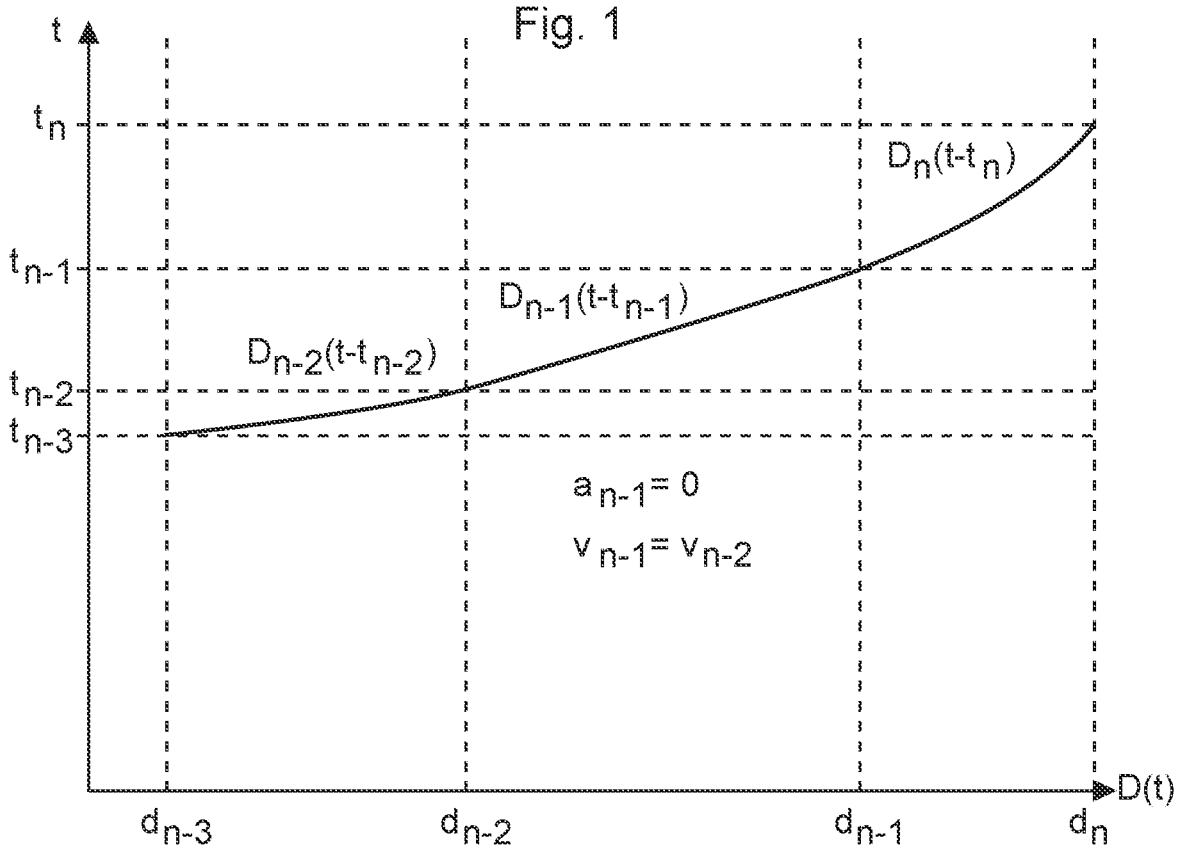
FIG. 2 illustrates three segments of a flight trajectory in an illustrative diagram.

Further explanations are given based on FIG. 2. According to at least one aspect of the invention, it is assumed that the acceleration within each segment is constant. Based on this assumption, a model is used in which the distance over ground D(t) for each segment is expressed as a quadratic polynomial and D(t) is a piecewise-defined function.

This model enables us to perform analytic calculations with segments of trajectories. Specifically, it is possible to calculate in closed form the time separation θ (at the end of both trajectories) required by a segment of the trajectory A and a segment of the trajectory B such that the minimum separation σ is obeyed for all times where both segments are defined.

For this, the following notation is used to describe one trajectory. We use the index n ($1 \leq n \leq N$, where N is the number of segments) to denote the segment which defines the trajectory for all t with $t_{n-1} \leq t \leq t_n$, where $t_{n-1}$ is the time when the flight will pass the start node of the segment and $t_n$ the corresponding time for the end node. The end node is thus the end node for the particular segment and can also be denoted as the following node. Now we can express the flying distance for any time t in that interval as $$D(t)=D_n(t-t_n)=1/2a_n(t-t_n)^2+v_n(t-t_n)+d_n \quad (1)$$

where $a_n$ is the acceleration throughout the segment n, $v_n$ the ground speed at the end node (i.e., when $t=t_n$), and $d_n$ the flying distance at the end node. The function D(t) is defined piece-wise as $D(t)=D_n(t-t_n)$ where $t_{n-1}<t\leq t_n$ for each n.

FIG. 2 illustrates three segments. The middle one with index n−1 is a segment of constant speed, i.e., $a_{n-1}=\theta$ and $v_{n-1}=v_{n-2}$.

We require continuity, i.e., $d_{n-1}=D_n(t_{n-1}-t_n)$, but no differentiability of the complete function D(t). Also, the speeds have to be positive at every point in time.

Let us choose the function D(t) to be zero when the flight arrives at the point P (the runway). This can be achieved by shifting all the $d_n$ of one trajectory by a constant value. D(t) may then be interpreted as the negative distance to go (DTG) of the flight at the time t.

It has to be noted, that even though this model corresponds to the laws of physics, this is still an approximation. In climb or descend, the Indicated Air Speed (IAS) is kept constant, which has a non-linear relationship with altitude and ground speed. The speeds $v_n$ are ground speeds.

Figure 3:
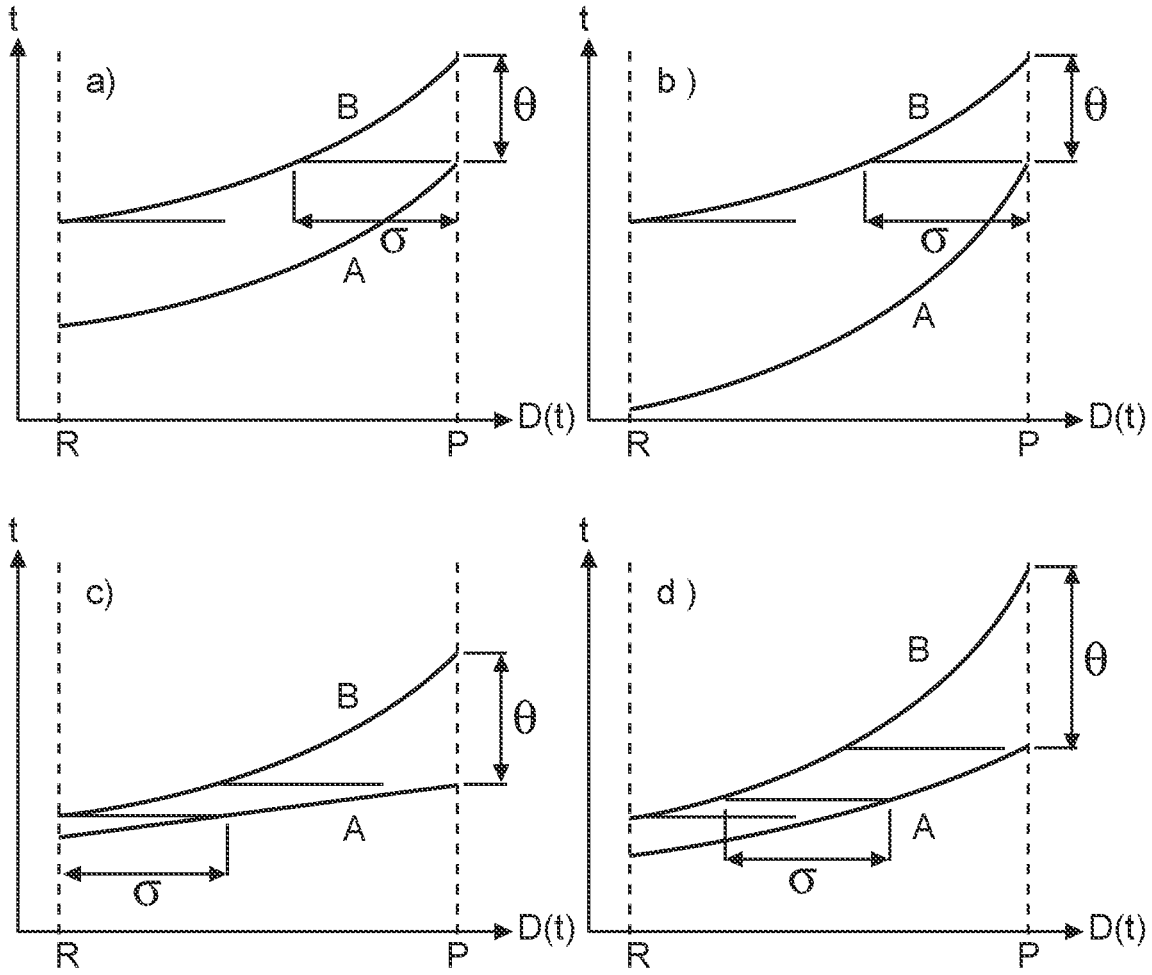
FIG. 3 shows four examples of two flight trajectories each of different interrelation as illustrative diagrams.

It is helpful to illuminate the variations appearing during the task of determining the time separation θ, by discussing four examples which are shown in FIG. 3. The required separation σ is represented by several horizontal black bars of the same lengths. This way it can be easily compared with the distance S of the flights.

In example a), let the two flights A and B land with the same speed and altitude profile, i.e., at a given distance from the runway, both flights will have the same given ground speed. Also, both flights will only decelerate.

At any point in time the second flight B will be further away from the runway and therefore be faster than the first flight A. From this it is immediately clear, that the distance S of the flights will always decrease with increasing time. Therefore, the moment of closest approach of flight B and flight A will be the time, when flight A lands, which is marked with σ in FIG. 3 which corresponds to $S_3$ in FIG. 1.

Note the optical illusion, the curve representing the trajectory of flight A seems to be steeper than that of flight B. This can be verified to be an illusion with a ruler by measuring the vertical distance of the lines at several points. They are equal.

In example b), the two flights start with the same speed at point R. Let flight A use a landing speed, which is lower than that of flight B. It is immediately clear, that flight A will always be slower than flight B at the same point in time. The same reasoning as in example a) applies.

In both examples, it is sufficient to ensure that flight B is at least the distance a from the runway, when flight A lands. Therefore, a planning tool shall use the time separation θ calculated as the flight duration of flight B for this last part of its approach of length σ.

These examples might lead to the assumption that it is always sufficient to ensure the separation σ at the point in time when the first flight A lands and that the time separation θ may always be calculated by determining the flight duration of the second flight B for the last σ-length of its approach. On the other hand, FIG. 1 already suggested otherwise, there clearly is an earlier point in time where the two curves have a minimal horizontal distance namely $S_2$.

In example c), the two flights A and B have the same speed at point R. The first flight A does not reduce speed and lands with the same speed. However, the second flight B reduces speed starting at point R.

The moment flight B starts decelerating, the distance between the two flights increases. Therefore, the minimum separation σ has to be ensured at the point in time when flight B reaches point R. The time separation θ may in this case be calculated as the flight duration of flight B from point R to point P reduced by the flight duration of flight A from a point which is the distance σ from point R to point P.

The example c) shows that it is not sufficient to use flight durations of the second flight B. However, it might still suggest, that in all cases a fixed point on the route may be found, where the check has to be performed.

This turns out to be wrong as example d) shows. As in example c), the flights A and B start with the same speed. Both flights reduce speed starting at point R.

However, flight A reduces a little and flight B reduces a lot.

When flight A arrives at point R, it will start reducing speed. Once flight B arrives at point R, flight A is slower than flight B. Flight B now starts reducing speed, but is still faster than flight A for a while. Therefore, the distance between the two flights will reduce further. Since flight B reduces its speed faster than flight A, both flights will at one point have equal speeds, unless flight A reaches point P first—which we assume not to be the case for this example. That moment in time where both have equal speeds will be the moment of closest approach of the two flights. The distance between flight A and flight B will increase afterwards, since flight B will gradually become slower than flight A.

If flight A reaches the runway before the moment of equal speed, we can proceed as in example a) an b) for the calculation.

The moment of equal speeds is highly dependent on the flight profiles of both flights and on the separation of the flights. Enlarging the separation will shorten the distance flight B has to slow down before flight A lands and it will decrease the speed of flight A when flight B passes point R and starts to reduce speed, thereby enlarging the speed difference flight B has to compensate.

It directly follows from this last example that the time separation θ necessary to ensure the required minimum separation σ has to be calculated based on a point in time $t_{min}$ of closest approach, which may be anywhere in the common definition interval of both trajectories. The time $t_{min}$ depends not only on the flight profiles of the two flights, but also on the required and/or predetermined separation σ or —equivalently—the resulting time separation θ.

Figure 4:
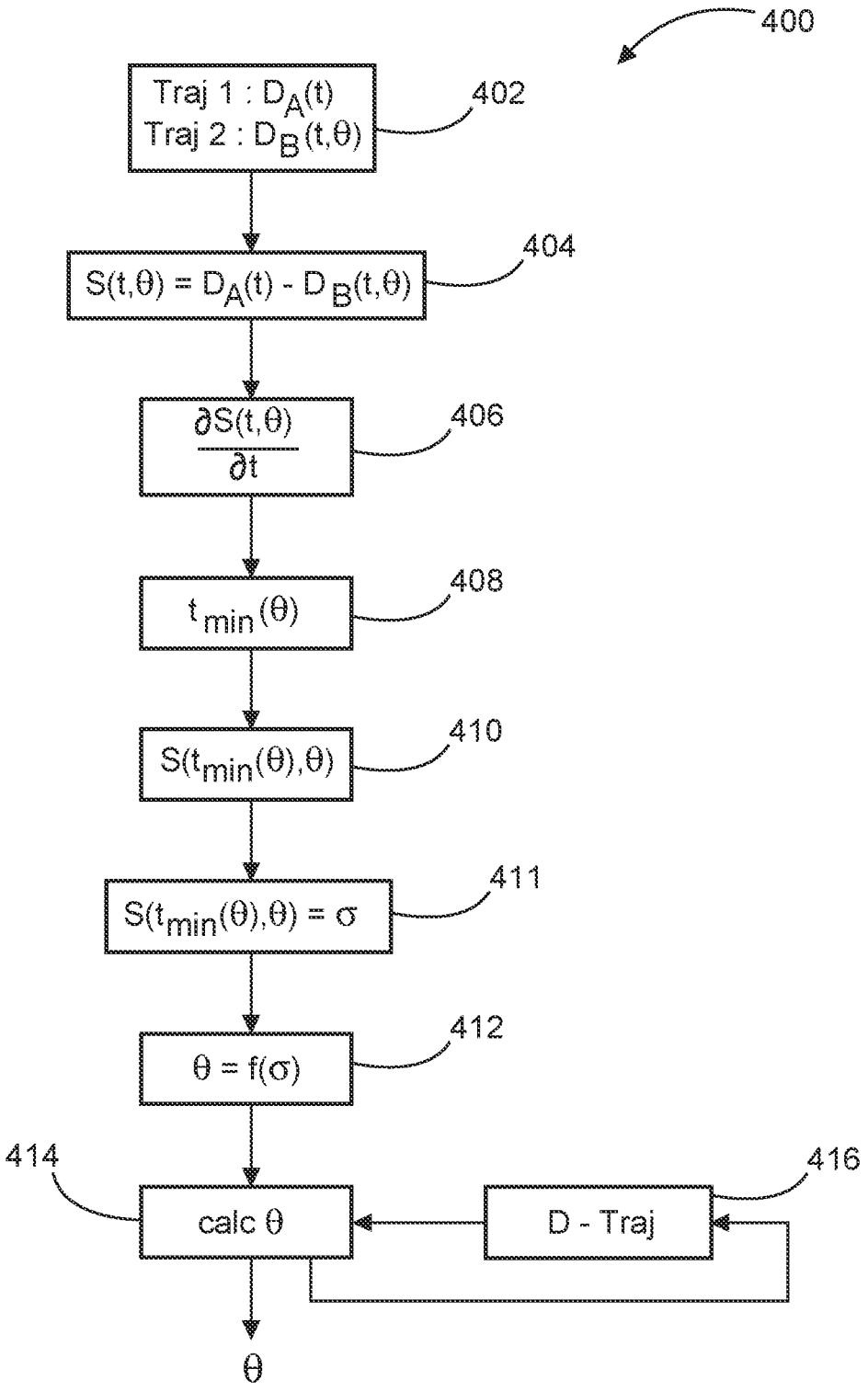
FIG. 4 shows a flow chart for calculating determination functions.

Note, that there was no reference to segments defining the trajectories of flight A and B. If the points R and P are, respectively, the start and end node of a single segment of the trajectory of flight A as well as of a single segment of the trajectory of flight B, the examples still apply. Therefore, example d) shows that the point in time $t_{min}$ of closest approach may be a point not given by a start node or end node of a trajectory segment. Therefore, just checking at the start and end points is not sufficient. FIG. 4 basically illustrates how the determination function is found and how it is used. Therefore, FIG. 4 shows a general flow chart 400 beginning with a definition block 402. In the definition block 402 the first and second trajectories are defined and according to the illustrated aspect these are defined as distance functions for the first and the second flight trajectory and thus for the first and the second flight. For the first flight trajectory there is defined the distance function $D_A(t)$. For the second flight trajectory there is defined the distance function $D_B(t, \theta)$. Accordingly, the first distance function $D_A$ does not depend on the arrival time difference θ but the second distance function $D_B$ depends on the arrival time difference θ. The arrival time difference θ can also be denoted as time separation θ at the runway. Both expression are synonyms in this description.

Based on these definitions the separation function S(t, θ) is defined as a difference between the first and second distance functions. This is done in the separation block 404.

Based on that, a further step is performed in the boundary check block 406. In the boundary check block 406 the first step, which is illustrated in FIG. 4 in the boundary check block 406, is to differentiate the separation function received from the separation block 404 with respect to time. The result is evaluated at the boundary times of overlapping segments, i.e., of the validity intervals of the considered analytic expressions for the separation function. The signs of the results indicate the positions of local minimum points $t_{min}$ of the separation function which may be situated at boundary times or within a validity interval. Depending on this result, the minimum point $t_{min}$ is determined in the minimum point block 408 either as the indicated boundary time or as the result of setting the derivative of the separation block obtained in the boundary check block 406 to zero and resolving for the time in order to receive an analytic expression for the minimum point $t_{min}$. In the minimum point block 408 it is thus illustrated that the point in time of minimum distance $t_{min}$ is dependent on the arrival time difference θ and accordingly the minimum point block 408 shows $t_{mjn}(\theta)$.

This minimum time point $t_{min}$ is than inserted in the separation function in order to further receive an analytic expression of the separation function. This analytic expression for the separation function is than independent of time as the analytic expression for the time of minimum distance $t_{min}$ is inserted, which depends on θ. That is shown in the time eliminated block 410. According to that, the separation function $S(t_{min}(\theta), \theta)$ with eliminated time is described as an analytic expression which only depends on θ. For any θ the value $S(t_{min}(\theta), \theta)$ of is the minimum value of the separation function.

The next step is to set this analytic expression for the separation function $S(t_{min}(\theta), \theta)$ equal to the predetermined minimum separation σ. This is illustrated in the minimum condition block 411. A further step it to resolve this equation to get an analytic expression for calculation the arrival time difference θ. This is basically the determination function and thus this further step is illustrated in the determination block 412. According to the determination block 412 the determination function is an analytic expression for calculating the arrival time difference $\theta = f(\sigma)$. This determination function is still an analytic expression but there might be more than one determination functions depending on rules and conditions. Particularly, results of the boundary check block 406 and resolving the analytic expression for the separation function according to the time eliminated block 410 results in a plurality of determination functions. These determination functions depending on rules and conditions are described further below in more detail.

The determination function or determination functions according to the determination block 412 depend on the general description of the flight trajectories according to the definition block 402, but do not depend on particular flight trajectories, i.e., do not depend on particular values of flight trajectories. Accordingly, the steps from the definition block 402 to the determination block 412 only need to be done once. Accordingly, these steps, in particular any resolving steps, may be complicated or at least be done offline. In order to now use the determination function to calculate a particular value for the arrival time difference θ for a particular pair of flight trajectories the calculation block 414 is provided. Besides receiving the determination function from the determination block 412 the calculation block also receives individual flight trajectories, in particular individual distance functions from the data block 416. The data block 416 thus constantly or at least frequently and/or repeatedly provides new individual data.

Accordingly, the calculation block 414 uses the determination function which is basically an analytic expression for each determination function and applies this to the individual flight trajectories received from the data block 416. The result is a particular arrival time difference θ, i.e., a particular value for the arrival time difference θ. Based on that the second flight trajectory of the pair of flight trajectories which the calculation block 414 has just received from the data block 416 can be amended such that its arrival time is deferred by this arrival time difference θ with respect to the arrival time of the first flight trajectory of the same pair of flight trajectories.

Accordingly, the particular value for the arrival time difference θ is the output of the calculation block 414 and the process then returns to the data block 416 in order to provide a new pair of flight trajectories in order to calculate a new arrival time difference θ. In such new pair of flight trajectories the first flight trajectory may be the second flight trajectory of the previous pair of flight trajectories.

It is to be noted that the calculation block 414 may comprise a plurality of calculation loops which will be explained with respect to FIG. 5.

Accordingly, the iteration flow chart 500 basically represents the calculation block 414 of FIG. 4. It starts with a data block 516, which may indeed be identical to the data block 416. It provides a pair of flight trajectories and delivers this data to the initialization block 502. In the initialization block 502 there is calculated as a starting value a minimum arrival time difference $\theta_0$. This initial or minimum arrival time difference $\theta_0$ is characterized by the index 0 (zero) in order to indicate that this can be understood as an initial value in the following iteration loop. However, one starting value for this minimum arrival time difference may be calculated as a flight duration of the second aircraft for a final part of its flight trajectory of length equal to the predetermined minimum separation before reaching the runway. Accordingly, the initial arrival time difference $\theta_0$ depends on the predetermined minimum separation G.

This starting value is passed to the segments determination block 504. In the segment determination block 504 a pair of trajectory segments is determined.

When first using this segment determination block 504 an index i is initialized with 1 and the first pair of trajectory segments comprises the segment of the first flight trajectory having the runway as one node and the segment of the second flight trajectory which contains the point with remaining flying distance equal to the predetermined minimum separation σ. In other words, when first applying the segment determination block 504 the first pair of segments comprises the segment of the first flight trajectory of the last part of the flight trajectory.

During each subsequent use of the segment determination block 504 the index i is increased by one and either for the first trajectory or the second trajectory or both the current trajectory segment is exchanged by a new current trajectory segment. The new trajectory segment is chosen such that the current trajectory segment and the new current trajectory segment are connected by having a common node and the new trajectory segments of both trajectories overlap in the time domain. For this, the node times of the start nodes of the current trajectories under the assumption that the second trajectory is parametrized with the previous value of the minimal arrival time difference are compared and the current trajectory segment with the larger node time is exchanged with a new trajectory segment. Both are exchanged at the same time only if the common node connecting the current and the new trajectory segments have the same node time for the first and the second trajectory, Based on this pair of segments, a new minimum arrival time difference $\theta_i$ is calculated. This new minimum arrival time difference $\theta_i$ can also be named as minimal value of the arrival time difference. It is thus calculated an arrival time difference as small as possible to still ensure that the minimum separation σ is ensured for the current pair of segments. This is done in the parameter calculation block 506. The result is forwarded to the comparison block 508. In the comparison block 508 the new and the previous value of the minimal arrival time difference $\theta_{i-1}$ are compared and the bigger one is taken. Accordingly, if in the comparison block 508 it was found that the new minimum value of the arrival time difference, i.e., the one just calculated in the parameter calculation block 506, is smaller than the old one, the new one $\theta_i$ is increased to the old one $\theta_{i-1}$. That is done in the allocation block 510. Otherwise, the old value will not be changed.

The flow chart goes further to the all pairs block 512. In the all pairs block 512 it is evaluated whether all possible pairs of segments for the current two flight trajectories have been considered. If not, the all pairs block 512 branches back to the segment determination block 504. Otherwise, it goes on to the final block 514. In the final block 514 the value of the arrival time difference θ is set to the current new value of the minimal arrival time difference $\theta_i$. In other words in the final block the arrival time difference will be set to the maximum value of all minimal values of the arrival time difference of all minimal arrival time differences calculated in the parameter calculation block 506 or the initialization block 502. The result is output as the arrival time difference θ and can be used to adjust the current second flight trajectory.

It is to be noted that the iteration flow chart 500 does not seem to receive an input from the determination block 412 according to FIG. 4. However, FIG. 4 is just illustrating that the blocks 402 to 412 make an offline calculation and the result is then used for the online calculation. In other words the result, i.e., the plurality of determination functions, calculated in the determination block 412 are implemented basically in the parameter calculation block 506 as fixed determination functions, i.e., being defined in an analytical way by analytic expression. Accordingly, for calculation or adjusting one flight trajectory after another of each current pair of flight trajectories is basically only done by using the calculation illustrated by the iterative flow chart 500.

Figure 6:
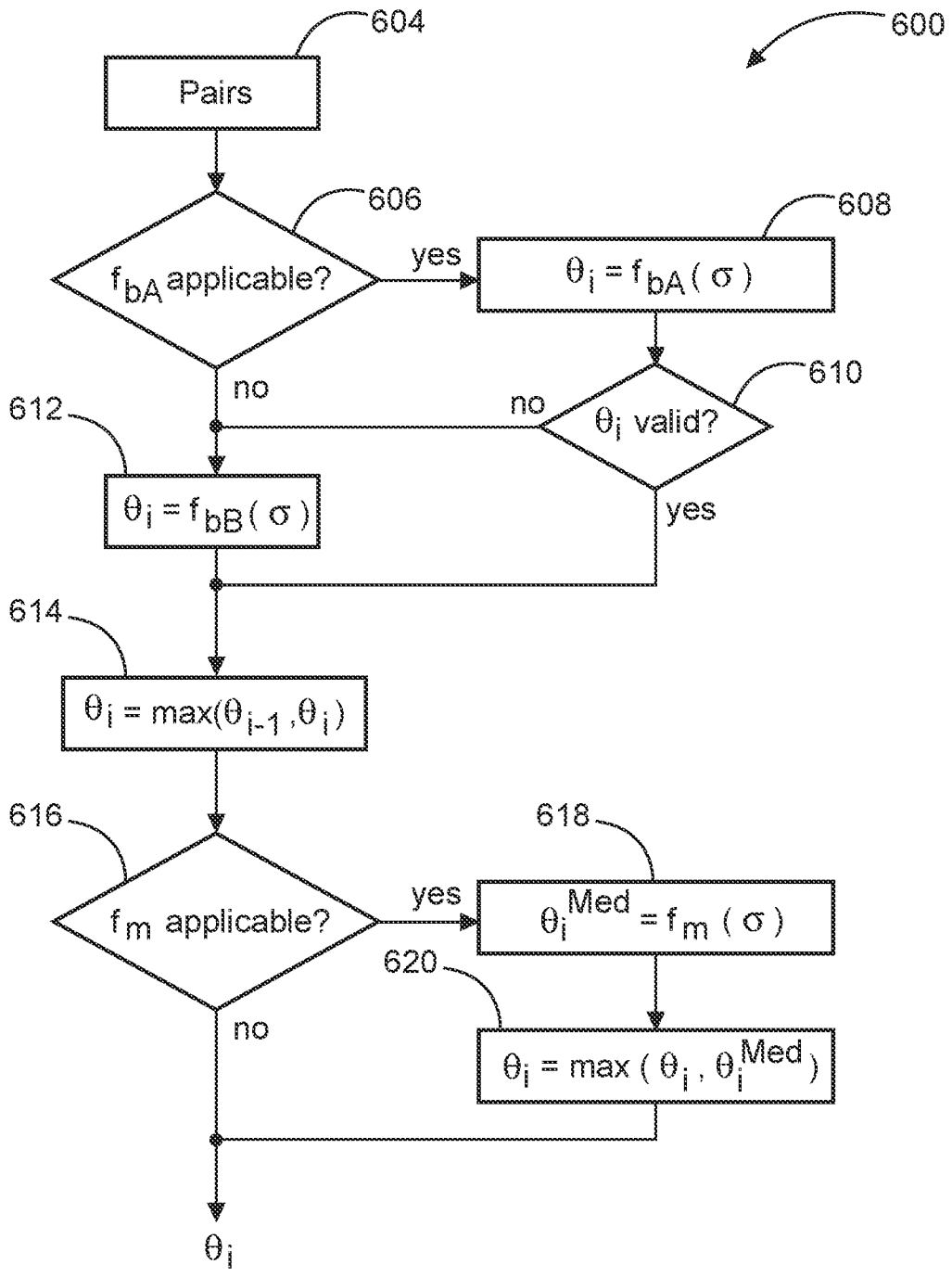
FIG. 6 shows a flow chart for determining the new minimum arrival time difference at the parameter calculation block of FIG. 5.

The parameter calculation block 506 comprises of steps and decisions which will be explained with respect to FIG. 6.

Figure 5:
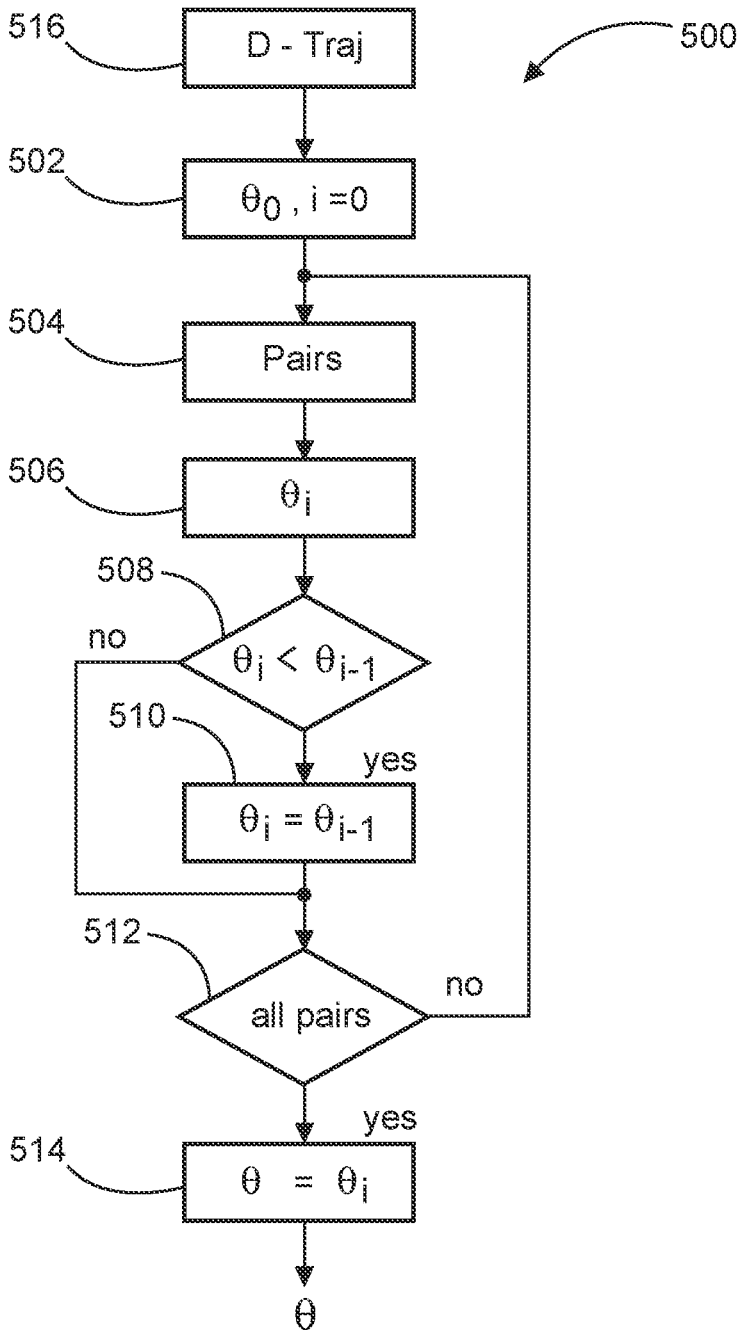
FIG. 5 shows a flow chart having an iteration for finding a minimal value for the at least one adjustable trajectory parameter.

Accordingly, the parameter calculation flow chart 600 represents the parameter calculation block 506 of FIG. 5. It starts with the segments determination block 604 which may indeed be identical with the segments determination block 504. It provides a pair of trajectory segments, one from the first trajectory and one from the second trajectory to the boundary choice block 606. Block 604 ensures that this pair of trajectory segments overlaps as described for the segments determination block 504.

In the boundary choice block 606 it is checked whether the segment of the first trajectory determines the beginning of a common validity interval of both segments. If yes, it is continued with the first boundary calculation block 608, otherwise, with the second boundary calculation block 612. In the first boundary calculation block 608 a determination function $f_{bA}(\sigma)$ is evaluated as a candidate minimum arrival time difference $\theta_i$. In the following candidate evaluation block 610 it is checked whether this candidate $\theta_i$ is a valid choice by checking if the segment of the first trajectory determines the beginning of the common validity interval of both segments under the assumption that the adjustable trajectory parameter ($\theta$) of the second trajectory is chosen as the candidate $\theta_i$. If this is the case, the candidate is handed to the boundary allocation block 614, otherwise the candidate is rejected and processing continues with the second boundary calculation block 612.

In the second boundary calculation block 612 a determination function $f_{bB}(\sigma)$ is evaluated as the candidate minimum arrival time difference $\theta_i$, which is handed to the boundary allocation block 614. In the boundary allocation block 614 the candidate arrival time difference $\theta_i$ is set to the old arrival time difference $\theta_{i-1}$ if the latter is bigger. In the following intermediate check block 616 it is checked whether the separation function has a minimum within the common validity interval of both segments which is not at the boundaries of the common validity interval. If yes, processing continues with the intermediate calculation block 618, otherwise the candidate arrival time difference $\theta_i$ is the result of the parameter calculation block 506. In the intermediate calculation block 618 a determination function $f_m(\sigma)$ is evaluated as the candidate minimum arrival time $\theta_i^{Med}$ which in the final allocation block 620 is compared with the candidate $\theta_i$ from the boundary allocation block 614. The larger of the two candidates $\theta_i$ and $\theta_i^{Med}$ is then used as the result of the parameter calculation block 506.

In the following further details in particular of formulas used for receiving the analytic expressions for the determination functions, i.e., basically the result according to the determination block 412 are explained in detail below. The formulas also include explanations regarding the conditions and rules to be considered. The formulas also include explanations for details illustrated by the iterative flow chart 500 of FIGS. 5 and 600 in FIG. 6. It is also noted that the flow charts 400, 500, and 600 each may use simplified formula or simplified variable expressions or parameters for illustrative purposes. In other words the formulas and expressions explained below may be different to some formulas or expressions used with respect to FIGS. 4, 5, and 6, but still explain the same thing.

The task is to determine the time separation $\theta$ at the runway, i.e., the arrival time difference $\theta$, such that the separation $$S(t)=D_A(t)-D_B(t)$$

is never below a given required separation $\sigma$ for all points in time t.

One approximate approach would be to estimate a $\theta$ and to check that $S(t)\geq\sigma$ for closely spaced values of t over the valid range of t. If this check fails at one point, increase $\theta$ and start over again. Another approach would be to determine the three values $S_1$, $S_2$, and $S_3$ for an estimated $\theta$ and for a given pair of segments and stepwise enlarge the estimate of $\theta$ as long as one of them is below $\sigma$. The suggested method does not do either of these.

Enlarging $\theta$ means changing at least one of the trajectories of flight A and B. We choose to keep the landing time of flight A fixed and adjust the trajectory of flight B such that it lands $\theta$ seconds after flight A. Thus, $D_A(t)$ is independent of $\theta$ and $D_B(t)=D_B(t, \theta)$ depends on, i.e., the separation at a given point in time t depends also on $\theta$:

$$S(t,\theta)=D_A(t)-D_B(t,\theta).$$

As we have shown with example d), the point in time $t_{min}$, where the separation $S(t, \theta)$ reaches its minimum will change with $\theta$. $t_{min}(\theta)$, i.e., it is not possible to determine $t_{min}$ independently of $\theta$, insert the result in $S(t_{min}, \theta)=\sigma$, and solve for $\theta$. The resulting $\theta$ would lead to a changed $t_{min}$ invalidating the result for $\theta$. Nevertheless, this could be the basis for another iterative approach. However, the suggested method is more direct:

For one pair of trajectory segments the correct $\theta$ is determined in one analytic calculation. The place of minimum of $S(t_{min}, \theta)$ is analytically determined as $t_{min}(\theta)$, e.g., by solving $$\frac{\partial S(t, \theta)}{\partial t} = 0$$

for t. The resulting expression for $t_{min}(\theta)$ is then inserted in $$S(t_{min}(\theta),\theta)=\sigma$$

which may then be solved for $\theta$. This will eliminate the dependency on t and give us an expression for $\theta$ which only depends on a and the parameters defining the form of $S(t, \theta)$.

The results will be given below, after the dependency on the validity intervals of the trajectory segments and a number of other parameters and terminology have been defined.

The presented mechanism is still iterative, since this analytic calculation has to be done for each overlapping pair of trajectory segments. In contrast to the possible approaches hinted at above, only a single calculation is needed for each overlapping pair of trajectory segments. For each segment pair, the result is determined analytically.

To further explain the mechanism, let us fix the trajectory of flight A such that it lands (arrives at P) at time $\theta$ and vary the trajectory of flight B such that it arrives at time $\theta$. Since the functions D(t) were chosen to be zero at P, this may be expressed as $$D_A(0)=0$$

$$D_B(\theta,\theta)=0$$

The first equation may be used to fix the parameters $t_{An}$ and ensure that they are independent of $\theta$. The second equation helps making the dependency of $D(t, \theta)$ on $\theta$ explicit by $t_{Bn}(\theta)=\theta-\Delta t_{Bn}$, where $\Delta t_{Bn}$ is the positive flying time (time to go) of flight B from the end node of segment n to point P. (Similarly, $t_{Am}=-\Delta t_{Am}$.) This results in:

$$D_B(t, \theta) = D_{Bn}(t - t_{Bn}(\theta)) = D_{Bn}(t - \theta + \Delta t_{Bn})$$

$$= \frac{1}{2}a_{Bn}(t - \theta + \Delta t_{Bn})^2 + v_{Bn}(t - \theta + \Delta t_{Bn}) + d_{Bn}$$

-continued $$D_A(t) = D_{Am}(t - t_{Am}) = D_{Am}(t + \Delta t_{Am})$$

$$= \frac{1}{2}a_{Am}(t + \Delta t_{Am})^2 + v_{Am}(t + \Delta t_{Am}) + d_{Am}$$

Reference numerals shown below in parenthesis refer to blocks in the structures of FIGS. 5 and 6, i.e., said explained steps or even formulas may be implemented in the corresponding block according to the cited reference numeral.

The input into the mechanism are the characteristic parameters describing all segments of the first trajectory, i.e., of the trajectory of flight A, $a_A$, $v_A$, $d_A$, and $\Delta t_{m\ A}$ for all $1 \le m \le N_A$ and $\Delta t_{A0}$, the characteristic parameters describing the second trajectory, i.e., the trajectory B, $a_{Bn}$, $v_{Bn}$, $d_{Bn}$, $\Delta t_{Bn}$ for all $1 \le n \le N_B$ and $\Delta t_{B0}$), and the required separation $\sigma$. Possibly also parameters restricting the range in which this separation shall be ensured. Accordingly, index A refers to trajectory A, i.e., the first trajectory and index B refers to trajectory B, i.e., the second trajectory. (516)

This is a short overview of the mechanism, which is elaborated in the sections below:

- Determine the initial segment n of the trajectory B such that $d_{n-1} < \sigma \le d_n$ holds. All segments of trajectory B with larger indices are considered to be handled in the following:
  - Determine an initial $\theta_0$ with function $f_0(\sigma)$ ensuring sufficient separation at t=0. (502)
- Iterate backwards according to an iteration described below handling pairs of segments starting with segment $m=N_A$ of the trajectory A and segment n of trajectory B as determined before:
  - Choose segment m of the trajectory A and segment n of trajectory B such that:
    - they overlap; and
    - all segments with higher indices have been handled.

This may always be achieved by decrementing either m, or n, or both. (504)

- If $t_{Bn-1}(\theta_{i-1}) \le t_{Am-1}$ (606), determine or $\theta_i^{MaxA}$ with the determination function $f_{bA}(\sigma)$. (608)
  - If then $\theta_i^{MaxA} \le \theta_{i-1}$ holds, let $\theta_i^{Max} = \theta_{i-1}$. (614)
  - If $\theta_i^{MaxA} > \theta_{i-1}$ and $t_{Bn-1}(\theta_i^{MaxA}) \le t_{Am-1}$ also holds, let $\theta_i^{Max} = \theta_i^{MaxA}$. (610)
  - Otherwise, no $\theta_i^{MaxA}$ is found, yet.
- If no $\theta_i^{MaxA}$ is found, determine or $\theta_i^{MaxB}$ with the determination function $f_{bB}(\sigma)$. (612)
- If $\theta_i^{MaxB} > \theta_{i-1}$ let $\theta_i^{Max} = \theta_i^{MaxB}$. (614)
- If no $\theta_i^{Max}$ is found, let or $\theta_i^{Max} = \theta_{i-1}$. (614)
- If the inequalities (12) hold for $\theta = \theta_i^{Max}$ (616), determine $\theta_i^{Med}$ with the determination function $f_m(\sigma)$. (618)
- Select $\theta_i = \max(\theta_i^{Max}, \theta_i^{Med})$. (620)
- If $t_{Bn-1}(\theta_i) \le t_{Am-1}$, the segment m of trajectory A is handled. Otherwise segment n of trajectory B. (504)
- The final $\theta_i$ is the result of the mechanism. (514) Even when an iteration leads to an increased time separation ($\theta_i > \theta_{i-1}$) there is no need to re-iterate the segments of the trajectories already handled in earlier iterations.

In an initializing step, $\theta_0$ is determined such that the second flight B is exactly the distance a before the point P at the time 0 when flight A arrives at point P. This may be done by solving the following equation for $\theta_0$:

$$D_B(0, \theta_0) = -\sigma$$

For this, the correct segment n of $D_B(t, \theta)$ may be found with $d_{n-1} < \sigma \le d_n$, and with equation (1) we get:

$$D_{Bn}(0 - t_{Bn}(\theta_0)) = D_{Bn}(0 - \theta_0 + \Delta t_{Bn}) = -\sigma.$$

This equation is either quadratic or linear in $\theta_0$ and therefore has three possible solutions, the two signs of the root and the linear case. The solution is the function $\theta_0 = f_0(\sigma)$.

An iteration will be described and from now on we will use the index n for the current segment of the trajectory of flight B and the index m for the current segment of the trajectory of flight A. The indices are decreased as we iterate backward over the trajectories. $D_{Bn}$ and $D_{Am}$ are the corresponding functions describing the current segments, $a_{Bn}$, $v_{Bn}$, $d_{Bn}$, $\Delta t_{Bn}$ the parameters determining $D_{Bn}$, and $a_{Am}$, $v_{Am}$, $d_{Am}$, $\Delta t_{Am}$ the parameters determining $D_{Am}$.

The initial index n for t=0 is the same as the one used when determining $\theta_0$. For it holds $$t_{Bn-1}(\theta_0) \le 0 \le t_{Bn}(\theta_0)$$

The initial index $m=N_A$ denotes the last segment of the trajectory for which $d_{Am}=0$ and $t_{Am}=\Delta t_{Am}=0$.

Each iteration i=1, 2, . . . consists of the following steps:

- Determine a $\theta_i \ge \theta_{i-1}$ as described below.
- Decrease either m if $t_{Bn-1}(\theta_i) < t_{Am-1}$, or n if $t_{Bn-1}(\theta_i) > t_{Am-1}$, or both if $t_{Bn-1}(\theta_i) = t_{Am-1}$.

For each pair n, m, the $\theta_i \ge \theta_{i-1}$ will be determined below such that the separation $\sigma$ is obeyed for all times t in the common validity interval:

$$S(t, \theta_i) \ge \sigma \text{ for all } \max(t_{Bn-1}(\theta_i), t_{Am-1}) \le t \le \min(t_{Bn}(\theta_i), t_{Am}). \quad (2)$$

Assuming the previous check has shown that $$S(t, \theta_{i-1}) \ge \sigma \text{ for all } \min(t_{Bn}(\theta_{i-1}), t_{Am}) \le t \le 0 \quad (3)$$

it follows that $$S(t, \theta_i) \ge \sigma \text{ for all } \max(t_{Bn-1}(\theta_i), t_{Am-1}) \le t \le 0, \quad (4)$$

assuming the speed is never negative. This is then the condition (3) for the next iteration when incrementing i and decrementing either n or m or both as explained above. The larger of $t_{Bn-1}(\theta_i)$ and $t_{Am-1}$ will become $t_{Bn}(\theta_{i-1})$ or, respectively, $t_{Am}$.

The mechanism continues traversing the trajectories backwards toward the beginning, decreasing either m or n or both and increasing i, until one of a number of end-conditions has been reached. It stops when n or m reaches zero. It may possibly stop, when other conditions are satisfied, e.g., when m reaches the point where the predecessor trajectory merges with the successor route, or when a maximum DTG is reached by the predecessor.

When all iterations are done, the last $\theta_i$ will be our final result. If one of the trajectories was fully iterated, it will hold $$S(t, \theta_i) \ge \sigma \text{ for all } \max(t_{B0}(\theta_i), t_{A0}) \le t \le 0, \quad (5),$$

i.e., for the whole time interval where both trajectories are defined. Otherwise, in the presence of other stop-conditions, it will be true for all t where both trajectories are defined and the other conditions are satisfied.

A separation of a pair of segments will now be described and it remains to show, how for a given pair of indices m and n the $\theta_i$ is determined which satisfies equation (2).

With $t_{min}$ we will denote the point in time where flight A and B have their closest approach within the current combined validity interval $\max(t_{Bn-1}(\theta_i), t_{Am-1}) \le t \le \min(t_{Bn}(\theta_i), t_{Am})$ of the current segments of both trajectories. Unless equation (2) is already satisfied for $\theta_i = \theta_{i-1}$, we will determine $\theta_i > \theta_{i-1}$ such that $$S(t_{min}, \theta_i) = \sigma \quad (6)$$

holds. Note, that $t_{min}$ depends on the form of S as well as on $\theta_i$.

There are three candidates which have to be considered and checked separately:

$$t_{min}^{max}=\max(t_{Bn-1}(\theta_i),t_{Am-1})$$

$$t_{min}^{Min}=\min(t_{Bn}(\theta_i),t_{Am-1})$$

$$\mathrm{MAX}(t_{Bn-1}(\theta_i),t_{Am-1})<t_{min}^{Med}<\min(t_{Bn}(\theta_i),t_{Am})$$

For each candidate for $t_{min}$, a $\theta_i$ may be found which would satisfy equation (2) if the true $t_{min}$ were equal to the candidate. We will call these solutions $\theta_i^{Max}$, $\theta_i^{Min}$, and $\theta_i^{Med}$, respectively. The largest of these will be the solution $\theta_i$, since a larger $\theta$ always leads to a larger S(t, $\theta$) and thus if the largest candidate satisfies equation (2), the other two candidates will, as well. This will automatically determine, which of the candidates is the true $t_{min}$, i.e., the time of the closest approach within the current combined validity interval.

For the candidate $t_{min}^{Min}$ at the end of the interval, equation (3) and continuity of the function S(t, $\theta$) directly show that $\theta_i^{Min}=\theta_{i-1}$ already satisfies equation (2).

The cases "Max" and "Med" will be handled as follows: The case is handed by inserting $$t_{min}^{Max}=\max(t_{Bn-1}(\theta_i^{Max}),t_{Am-1})$$

in equation (2) and solving the equal case of equation (2) for $\theta_i^{Max}$:

$$S(\max(t_{Bn-1}(\theta_i^{Max}),t_{Am-1}),\theta_i^{Max})=\sigma$$

Due to the maximum, there are two cases, which we call "MaxB" and "MaxA".

It is important to note that $t_{Bn-1}(\theta)=\theta-\Delta t_{Bn-1}$ increases together with $\theta$ and may therefore become greater than $t_{Am-1}$ for a larger $\theta$ when it initially was less or equal for a smaller $\theta$.

Since we do not know $\theta_i^{Max}$, yet, it is not clear, which of the two cases hold, and we might have to check both. Initially, we can only use $\theta_{i-1}$. In the case, $$\max(t_{Bn-1}(\theta),t_{Am-1})=t_{Am-1} \tag{7}$$

for $\theta=\theta_{i-1}$, we have to start assuming that MaxA is relevant and have to find the solution $\theta_i^{MaxA}$ of the equation $$S(t_{Am-1},\theta_i^{MaxA})=\sigma. \tag{8}$$

The solution is the determination function $\theta_i^{MaxA}=f_{bA}(\sigma)$. If it results in $\theta_i^{MaxA}>\theta_{i-1}$ we have to re-check, that equation (7) still holds for $\theta=\theta_i^{MaxA}$ If it does not hold, $\theta_i^{MaxA}$ is not a valid candidate for $\theta_i$ and the case MaxB will result in a valid candidate.

Either if the MaxA case did not lead to a valid candidate, or if $$\max(t_{Bn-1}(\theta),t_{mn-1})=t_{Bn-1}(\theta), \tag{9}$$

already holds for $\theta=\theta_{i-1}$, the case MaxB has to be used. For this, we have to find the solution or $\theta_i^{MaxB}$ of the equation $$S(t_{Bn-1}(\theta_i^{MaxB}),\theta_i^{MaxB})=\sigma. \tag{10}$$

The solution is the determination function $\theta_i^{MaxB}=f_{bB}(\sigma)$. This will always satisfy equation (9) for $\theta=\theta_i^{MaxB}$, if $\theta_i^{MaxB}\geq\theta_{i-1}$:

$$t_{Bn}(\theta_{i-1})=\theta_{i-1}-\Delta t_{Bn}\leq\theta_i^{MaxB}-\Delta t_{Bn}=t_{Bn}(\theta_i^{MaxB}).$$

So far the mechanism has determined a $\theta_i^{Max}$ such that $$S(t,\theta_i^{Max})\geq\sigma \text{for all } t\geq\min(t_{Bb}(\theta_i^{Max}),t_{Am})$$

$$\text{and for } t=\max(t_{Bn-1}(\theta_i^{Max}),t_{Am-1}). \tag{11}$$

This can only lead to a larger $\theta_i^{Med}>\theta_i^{Max}$, if S(t, $\theta$) has a minimum between the boundaries of the validity interval, i.e., between $\max(t_{Bn-1}(\theta), t_{Am-1})$ and $\min(t_{Bn}(\theta), t_{Am})$, which may be checked with $$\left(\frac{\partial S(t,\theta)}{\partial t}\right)_{t=\max(t_{Bn-1}(\theta),t_{Am-1})}<0 \tag{12}$$

$$\text{and } \left(\frac{\partial S(t,\theta)}{\partial t}\right)_{t=\min(t_{Bn}(\theta),t_{Am})}>0.$$

These two conditions are necessary and sufficient due to the quadratic nature of S(t, $\theta$) for a given pair of indices m and n. It suffices to check these conditions for $\theta=\theta_i^{Max}$. They will then hold for any $\theta_i^{Med}>\theta_i^{Max}$.

In order to determine the formula for solution $\theta_i^{Med}$ for candidate $t_{min}^{Med}$, the time of the minimum $t_{min}^{Med}(\theta)$ has to be determined by solving $$\left(\frac{\partial S(t,\theta)}{\partial t}\right)_{t=t_{min}^{Med}(\theta)}=0.$$

The result $t_{min}^{Med}(\theta)$ has to be inserted in $$S(t_{min}^{Med}(\theta_i^{Med}),\theta_i^{Med})=\sigma, \tag{13}$$

and solved for $\theta_i^{Med}$. The solution is the determination function $\theta_i^{Med}=f_m(\sigma)$.

The step considering a pair m and n therefore results in a $\theta_i\geq\theta_{i-1}$ which is either $\theta_i=\theta_{i-1}$, $\theta_i=\theta_i^{MaxA}=f_{bA}(\sigma)$, $\theta_i\theta_i^{MaxB}=f_{bB}(\sigma)$, or $\theta_i=\theta_i^{Med}=f_m(\sigma)$. The analytical expressions for the determination functions $f_{bA}$, $f_{bB}$, and $f_m$ are obtained by solving equations (8), (10), and (13). They only depend on a and the parameters determining the trajectory segments $a_{Bn}$, $v_{Bn}$, $d_{Bn}$, $\Delta t_{Bn}$, $a_{Am}$, $v_{Am}$, $d_{Am}$, and $\Delta t_{Am}$ and may thus be efficiently implemented in a computer program.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method comprising:

planning flight trajectories for first and second aircraft aiming to subsequently approach a predefined reference point, wherein each aircraft travels along a flight route according to an individual flight trajectory, such that the first aircraft travels along a first flight route according to a first flight trajectory and the second aircraft travels along a second flight route according to a second flight trajectory, the planning comprising:

setting or adjusting at least the second flight trajectory such that at least one predetermined minimum separation between the first and second aircraft approaching the predefined reference point according to their respective flight trajectories is ensured, setting and adjusting an adjustable trajectory parameter of the first flight trajectory or the second flight trajectory such that the predetermined minimum separation is ensured throughout the whole flight trajectories, determining an initial minimal value for the adjustable trajectory parameter, determining a current pair of trajectory segments comprising a first segment of the first flight trajectory and a first segment of the second flight trajectory, wherein a following node of the first segment of the first flight trajectory defines a destination at a runway and the first segment of the second flight trajectory contains the point separated by the predetermined minimum separation from the runway, applying at least one determination function to the current pair of trajectory segments for determining or changing the minimal value of the adjustable trajectory parameter of the second flight trajectory, determining a new current pair of trajectory segments based on the determined minimal value of the adjustable trajectory parameter, and repeating the applying the at least one determination function and the determining the new current pair of trajectory segments until a minimal value for the adjustable trajectory parameter of the second flight trajectory is found such that the predetermined minimum separation is ensured for the complete second flight trajectory with respect to the first flight trajectory, wherein the adjustable trajectory parameter is an arrival time difference, wherein determining the new current pair of trajectory segments comprises exchanging for each of the first flight trajectory and the second flight trajectory the current trajectory segment by a new current trajectory segment, wherein the current trajectory segment and the new current pair of trajectory segments are connected by a common node, wherein the new current pair of trajectory segments overlap in a time domain, and wherein the first and the second flight trajectories are exchanged both at the same time only when the common node connecting the current and the new current pair of trajectory segments have a same node time for the first and the second flight trajectories, wherein applying the determination function to the current pair of trajectory segments is restricted to an overlapping area, wherein the overlapping area is defined by a time interval that covers both trajectory segments of the current pair of trajectories, and wherein determining the initial minimal value includes setting the adjustable trajectory parameter of the second flight trajectory as a starting point such that the predetermined minimum separation between the first and second flight trajectories occurs at the point in time when the aircraft according to the first trajectory lands, and wherein the initial minimum value of the adjustable trajectory parameter is calculated as a flight duration of the second aircraft for a final part of its flight trajectory of a length equal to the predetermined minimum separation before reaching the predefined reference point of a runway.

2. The method according to claim 1, wherein:

the first flight trajectory is associated to a preceding aircraft approaching the reference point before a following aircraft, the second flight trajectory is associated to the following aircraft reaching the reference point subsequently after the preceding aircraft, and at least part of the second flight trajectory is calculated or adjusted based on:

the first flight trajectory, and the minimum separation such that the second flight trajectory ensures the minimum separation with respect to the first flight trajectory.

3. The method according to claim 1, wherein:

each flight trajectory comprises at least one of:

a plurality of nodes, wherein each node is defined at least by:

a node location defining the location of the node;

a node time defining a point in time for the respective aircraft to reach the node location; and a flight speed of the respective aircraft at the node; and at least one trajectory segment connecting a preceding node and a following node; and each flight trajectory comprises a plurality of trajectory segments.

4. The method according to claim 1 wherein:

a position of the aircraft at any point in time within a trajectory segment between two nodes is modelled by a position function;

the time of the aircraft at any location within the trajectory segment between two nodes is modelled by a time function, and the position function or the time function, respectively, is given by a polynomial function, and/or comprises, or is based on, a predefined constant acceleration assuming a constant acceleration of the aircraft travelling along the respective trajectory segment.

5. The method according to claim 1, wherein:

a last node of each flight trajectory defines a destination at a runway, and/or a first node of each flight trajectory defines a starting point at a runway, and at least the first flight trajectory and the second flight trajectory use the same route but at different times and with individual flight speeds.

6. The method according to claim 1, wherein for each flight trajectory and each trajectory segment, a distance over ground is defined with respect to a predefined reference location by the following equation depending on time t:

$$D(t)=D_n(t-t_n)=1/2a_n(t-t_n)^2+v_n(t-t_n)+d_n,$$

wherein:

$D_n$ defines for trajectory segment n a distance D over ground to the predefined reference location, $d_n$ defines a distance of the following node of the trajectory segment n to the predefined reference location, $a_n$ defines a constant acceleration of the aircraft throughout the trajectory segment n, of the aircraft, $v_n$ defines the speed of the aircraft at the following node of the trajectory segment n, and $t_n$ defines the point in time at which the aircraft reaches the following node of the trajectory segment n, wherein $d_n$, $a_n$, $v_n$, and $t_n$, each forms a characteristic parameter of the trajectory segment.

7. The method according to claim 1, wherein the setting or adjusting of at least the second flight trajectory uses the at least one determination function for determining the adjustable trajectory parameter of the second flight trajectory, and the at least one determination function is calculated based on:

a separation function defining a separation between the first and second aircraft travelling according to the first and the second flight trajectory, at least for part of their travel, or at least for a part of the first and a part of the second flight trajectory:

the separation function depends on the first and second flight trajectories; and the separation function depends on the adjustable trajectory parameter of the second flight trajectory, wherein:

the at least one determination function is calculated by:

determining a point in time of a local minimum of the separation function as an analytical expression and wherein, the separation function is dependent on time;

the point in time of the minimum of the separation function is inserted into the separation function such that an analytical expression for the separation function at the minimum results which is independent of time; and the resulting separation function at the minimum is set equal to the predetermined minimum separation and resolved for the adjustable trajectory parameter, wherein:

the separation function S(t,θ) is defined as:

$$S(t,\theta)=D_A(t)D_B(t,\theta),$$

with:

t as the time,

θ defining as the adjustable trajectory parameter a time difference between the points of time for the first and the second aircraft to reach the predefined reference point, $D_A(t)$ defining an analytic expression for a distance of the first aircraft to the predefined reference point being dependent on time, and not being dependent on the time difference between the first and the second aircraft at the predefined reference point, and $D_B$ (t,θ) defining an analytic expression for a distance of the second aircraft to the predefined reference point being dependent on time and being dependent on the time difference between the first and the second aircraft at the predefined reference point.

8. The method according to claim 7, wherein:

the separation function is determined as an analytic expression, the separation function is given:

as the difference of the distance function $D_A(t)$ of the first flight trajectory and the distance function $D_B$ (t,θ) of the second flight trajectory, or as the difference of a trajectory segment of the first flight trajectory and a trajectory segment of the second flight trajectory, and wherein:

the separation function is differentiated with respect to time in order to find a or the minimum, the differentiated separation function is used to find an analytical expression for the point in time at which the separation function has its minimum, the analytical expression of time is inserted into the separation function and the separation function is set equal to the predetermined minimum separation in order to find a function depending on the predetermined minimum separation and being independent of time and resolving it in order to receive the at least one determination function, and the at least one determination function is dependent on the predetermined minimum separation.

9. The method according to claim 1, wherein:

a first distance function and a second distance function are each defined as analytical expressions for each trajectory segment of the first and second flight trajectory, respectively, a separation function is defined as an analytical expression for each time interval where segments of the first and second flight trajectories overlap, a point in time of the minimum of the separation function is determined as at least one analytical expression for each overlapping time interval, wherein the analytical expression depends on the adjustable trajectory parameter of the second flight trajectory, the method comprising determining the at least one determination function as an analytical expression based on each analytical expression of the point in time, the method comprising determining the adjustable trajectory parameter of the second flight trajectory using the at least one determination function such that the value of the minimum separation of the corresponding overlapping time interval will never be below the predetermined minimum separation, and wherein the separation function S(t, 0) is defined as:

$$S(t,\theta)=D_A(t)D_B(t,\theta),$$

with:

t as the time,

θ defining the adjustable trajectory parameter a time difference between the points of time for the first and the second aircraft to reach the predefined reference point, $D_A(t)$ defining the first distance function as an analytic expression for the distance of the first aircraft to the predefined reference point being dependent on time, and not being dependent on the distance (θ) between the first and the second aircraft at the predefined reference point, and $D_B$ (t,θ) defining the second distance function as an analytic expression for the distance of the second aircraft to the predefined reference point being dependent on time and being dependent on the distance between the first and the second aircraft at the predefined reference point.

10. The method according to claim 1, wherein:

the at least one determination function comprises at least one related characteristic parameter each corresponding to a characteristic parameter of the two current trajectory segments, and successively applying the at least one determination function by setting the value of each related characteristic parameter of the at least one determination function to the value of the corresponding characteristic parameter of the respective trajectory segment in order to determine a value of the adjustable trajectory parameter of the second flight trajectory.

11. The method according to claim 1, wherein:

the first flight trajectory is given as a fixed trajectory, the second flight trajectory is set or adjusted such that the at least one predetermined minimum separation between the first and second aircraft is ensured, and the adjustable trajectory parameter of the second flight trajectory is adjusted such that the second flight trajectory is shifted with respect to the first flight trajectory in order to thereby ensure the predetermined minimum separation between the first and second flight trajectories.

12. A computer-readable medium having computer-executable instructions stored thereon that, in response to execution by one or more processors of a computing device, cause the computing device to perform the method according to claim 1.

* * * * *